US009591387B2

(12) United States Patent
Wirth

(10) Patent No.: US 9,591,387 B2
(45) Date of Patent: Mar. 7, 2017

(54) LOUDSPEAKER WITH IMPROVED THERMAL LOAD CAPACITY

(71) Applicant: Eberspaecher Exhaust Technology GmbH & Co. KG, Neunkirchen (DE)

(72) Inventor: Georg Wirth, Kirchheim unter Teck (DE)

(73) Assignee: EBERSPAECHER EXHAUST TECHNOLOGY GMBH & CO. KG, Neunkirchen (DE)

( * ) Notice: Subject to any disclaimer, the term of this patent is extended or adjusted under 35 U.S.C. 154(b) by 428 days.

(21) Appl. No.: 14/050,584

(22) Filed: Oct. 10, 2013

(65) Prior Publication Data

US 2014/0105439 A1 Apr. 17, 2014

(30) Foreign Application Priority Data

Oct. 16, 2012 (DE) ..... 10 2012 109 872

(51) Int. Cl.
*H04R 1/02* (2006.01)
*H04R 1/00* (2006.01)
(Continued)

(52) U.S. Cl.
CPC ..... *H04R 1/00* (2013.01); *F01N 1/065* (2013.01); *H04R 9/022* (2013.01); *F28D 15/02* (2013.01)

(58) Field of Classification Search
CPC ..... F01N 1/065; G10K 2210/12822
(Continued)

(56) References Cited

U.S. PATENT DOCUMENTS 3,995,125 A * 11/1976 Cypser ..... H04R 1/023 381/391
4,177,874 A 12/1979 Angelini et al.
(Continued)

FOREIGN PATENT DOCUMENTS

DE 2802380 7/1979
DE 4317403 12/1994
(Continued)

OTHER PUBLICATIONS

European Patent Office, European Search Report in Application No. 13187192, mailed Nov. 28, 2013.
(Continued)

*Primary Examiner* — Nafiz E Hoque
(74) *Attorney, Agent, or Firm* — Morris & Kamlay LLP

(57) ABSTRACT

The present invention relates to a loudspeaker (1; 1'; 1") with a loudspeaker housing (2; 2'), a basket (3) held in the loudspeaker housing (2; 2') and bearing a permanent magnet (9), a coil (91) arranged in a constant magnetic field generated by the permanent magnet (9) and connected with a diaphragm (5), and at least one heat pipe (10) with a heating zone (Z1) and cooling zone (Z3), wherein the heating zone (Z1) is arranged on the permanent magnet (9), and the cooling zone (Z3) on the loudspeaker housing (2; 2').
The present invention further relates to the use of such a loudspeaker for actively extinguishing or influencing sound waves, and a noise control system (100) for exhaust systems of a vehicle powered by an internal combustion engine with such a loudspeaker (1; 1', 1").

16 Claims, 4 Drawing Sheets

(51) Int. Cl.

| | |
|---|---|
| ***F01N 1/06*** | (2006.01) |
| ***H04R 9/02*** | (2006.01) |
| *F28D 15/02* | (2006.01) |

(58) Field of Classification Search
USPC ..... 381/338, 386
See application file for complete search history.

(56) References Cited

U.S. PATENT DOCUMENTS

| | | | | |
|---|---|---|---|---|
| 4,210,778 | A * | 7/1980 | Sakurai | H04R 9/022 181/156 |
| 4,679,651 | A * | 7/1987 | Peeters | H04R 1/2819 181/155 |
| 5,229,556 | A | 7/1993 | Geddes | |
| 5,233,137 | A | 8/1993 | Geddes | |
| 5,336,856 | A | 8/1994 | Krider et al. | |
| 5,343,533 | A | 8/1994 | Geddes | |
| 5,432,857 | A | 7/1995 | Geddes | |
| 5,600,106 | A | 2/1997 | Langley | |
| 5,619,020 | A | 4/1997 | Jones et al. | |
| 5,703,337 | A | 12/1997 | Geisenberger | |
| 2006/0037808 | A1 | 2/2006 | Krueger et al. | |
| 2008/0053747 | A1 | 3/2008 | Krueger et al. | |
| 2009/0255754 | A1 | 10/2009 | Krueger et al. | |
| 2010/0243213 | A1 | 9/2010 | Obara | |
| 2011/0000734 | A1 | 1/2011 | Krueger | |

FOREIGN PATENT DOCUMENTS

| | | | |
|---|---|---|---|
| DE | 19751596 | | 6/1999 |
| DE | 10 2006 042 224 | | 1/2008 |
| DE | 10 2008 018 085 | | 10/2009 |
| DE | 10 2009 031 848 | | 1/2011 |
| EP | 0 373 188 | | 12/1993 |
| EP | 0 674 097 | | 9/1995 |
| EP | 0 755 045 | | 1/1997 |
| EP | 0 916 817 | | 5/1999 |
| EP | 1 055 804 | | 11/2000 |
| EP | 1 627 996 | | 7/2005 |
| JP | 53-164134 | | 12/1978 |
| JP | 57-001500 | | 1/1982 |
| JP | 59-148499 | | 8/1984 |
| JP | 59-169190 | | 11/1984 |
| JP | 04-104119 | A | 4/1992 |
| JP | 07-189646 | A | 7/1995 |
| JP | 10002616 | A | 1/1998 |
| JP | 2006-041314 | A | 2/2006 |
| JP | 2008-196787 | A | 8/2008 |
| JP | 2012182159 | A | 9/2012 |
| WO | 2008-023707 | A1 | 2/2008 |

OTHER PUBLICATIONS

Notification of Reasons for Rejection, issued Feb. 26, 2015 in corresponding Japanese Application No. JP 2013-209777.
Notification of Reasons for Rejection mailed Sep. 16, 2014 in corresponding Japanese Patent Application No. 2013-209777.

* cited by examiner

LOUDSPEAKER WITH IMPROVED THERMAL LOAD CAPACITY

CROSS-REFERENCES TO RELATED APPLICATIONS

This application claims priority to Patent Application No. 10 2012 109 872.7, filed Oct. 16, 2012 in Germany, the entire contents of which are incorporated by reference herein.

FIELD

The invention relates to a loudspeaker of the type used in exhaust systems of vehicles powered by internal combustion engines for actively extinguishing or influencing sound waves.

BACKGROUND

Regardless of the design of an internal combustion engine (for example, reciprocating piston engine, rotary piston engine or free piston engine), sequentially running cycles (in particular aspiration and compression of a fuel-air mixture (intake stroke and compression stroke), operation and emission of the combusted fuel-air mixture (combustion stroke and exhaust stroke)) generate noises. On the one hand, these pass through the internal combustion engine as structure-borne noise, and are emitted as airborne noise on the outside of the internal combustion engine. On the other hand, the noises pass through an exhaust system of the internal combustion engine as airborne noise together with the combusted fuel-air mixture.

These noises are often perceived as disadvantageous. On the one hand, there are noise protection laws that must be observed by manufacturers of vehicles powered by internal combustion engines. As a rule, these laws prescribe a maximum permissible sound pressure during vehicle operation. On the other hand, manufacturers are trying to impart a characteristic noise emission to the internal combustion engine-powered vehicles they produce that is intended to reflect the image of the respective manufacturer and appeal to the customer. In modern engines with a low engine displacement volume, this characteristic noise emission can often no longer be ensured with a natural approach.

The noises passing through the internal combustion engine as structure-borne noise are easy to attenuate, and thus generally pose no problem in terms of noise protection.

The noises passing through an exhaust system of the internal combustion engine as airborne noise together with the combusted fuel-air mixture are reduced by mufflers, which are placed before the exhaust system outlet, and can have catalytic converters situated upstream from them. For example, such mufflers can operate according to the absorption and/or reflection principle. The disadvantage to both operating principles is that they require a comparatively large volume, and offer a relatively high resistance to the combusted fuel-air mixture, thereby lowering the overall efficiency of the vehicle and raising fuel consumption.

As an alternative or supplement to mufflers, so-called active noise control systems were developed some time ago, which superimpose/overlay the airborne noise generated by the internal combustion engine and guided in the exhaust system with an electroacoustically generated antinoise. For example, such systems are known from documents U.S. Pat. No. 4,177,874, U.S. Pat. No. 5,229,556, U.S. Pat. No. 5,233,137, U.S. Pat. No. 5,343,533, U.S. Pat. No. 5,336,856, U.S. Pat. No. 5,432,857, U.S. Pat. No. 5,600,106, U.S. Pat. No. 5,619,020, EP 0 373 188, EP 0 674 097, EP 0 755 045, EP 0 916 817, EP 1 055 804, EP 1 627 996, DE 197 51 596, DE 10 2006 042 224, DE 10 2008 018 085 and DE 10 2009 031 848.

Such noise control systems usually use a so-called Filtered-x Last Mean Squares (FxLMS) algorithm, which attempts to zero out an error signal measured with an error microphone by emitting noise over at least one loudspeaker fluidically connected with the exhaust system, at least for selected frequency bands. In order to achieve a destructive interference by the sound waves of the airborne noise carried in the exhaust system and antinoise generated by the loudspeaker, the sound waves emanating from the loudspeaker must reflect the sound waves carried in the exhaust system in terms of amplitude and frequency, but be phase shifted relative to the latter by 180 degrees. The antinoise is separately calculated for each frequency band of the airborne noise carried in the exhaust system by means of the FxLMS algorithm by determining a suitable frequency and phase shift for two sinus oscillations offset relative to each other by 90 degrees, and calculating the amplitudes for these sinus oscillations. The goal of noise control systems is to have the noise cancellation be audible and measurable at least outside, but if applicable also inside the exhaust system. The term antinoise in this document is used as a differentiation relative to the airborne noise carried in the exhaust system. Viewed by itself, antinoise is conventional airborne noise.

A corresponding noise control system can also be procured from the company J. Eberspächer GmbH & Co. KG, Eberspächerstrasse 24, 73730 Esslingen, Germany.

The disadvantage to previously known noise control systems for exhaust systems is that an oscillating coil (voice coil) of the at least one loudspeaker might become thermally overloaded. This is caused by the energy input associated with continuously operating the loudspeaker on the one hand, and the high exhaust temperatures on the other.

Therefore, the object of the invention is to provide a loudspeaker that contains an improved thermal load capacity. Such loudspeakers are especially suitable for use in noise control systems for exhaust systems.

SUMMARY

Embodiments of a loudspeaker (in particular of an electrodynamic loudspeaker) comprise a loudspeaker housing, a basket held in the loudspeaker housing and bearing a permanent magnet, a coil arranged in a constant magnetic field generated by the permanent magnet and connected with diaphragm (membrane), and at least one heat pipe with a heating zone (high temperature end) and cooling zone (low temperature end), wherein the heating zone is arranged on the permanent magnet, and the cooling zone on the loudspeaker housing.

Also referred to as a "heatpipe", a heat pipe is a heat exchanger that uses the heat of evaporation of a working medium located in a sealed volume inside the heat exchanger to permit a higher heat flux density than a solid having the same dimensions. No mechanical aids/auxiliary means are required for circulating the working medium, since circulation optionally takes place by means of gravitational force (gravitation heat pipe or thermosiphon) or capillaries (heatpipe).

By using at least one heat pipe connected with the permanent magnet on the one hand and the loudspeaker housing on the other makes it possible to use the heat of evaporation of the working medium contained in the at least one heat pipe to provide a high heat flux density between the permanent magnet and loudspeaker housing employing a comparatively low amount of material. As a result, the coil heat can be dissipated to the outside of the loudspeaker indirectly by way of the permanent magnet, the at least one heat pipe and the loudspeaker housing.

In an embodiment, the at least one heat pipe has a tubular, hermetically sealed volume defined by a wall, capillaries accommodated inside the volume, and a working medium accommodated inside the volume, which fills the volume in (especially a smaller) part in liquid state, and in (especially a larger) part in gaseous state. The wall can be made out of plastic or metal, in particular copper. The capillaries can take the form of tubules composed of plastic and/or metal and/or fabric (in particular metal fabric) and/or braiding (in particular metal braiding). In particular, the working medium can be $(CH_3)OH$, $(CH_3)CO$, $NH_3$, $H_2O$, $C_6H_6$, since these substances contain an evaporation temperature lying within the range of the temperature of the coil, and hence the permanent magnet, that arises during loudspeaker operation.

In an embodiment, the sealed volume of the at least one heat pipe can further incorporate a buffer gas (e.g., helium or argon), which can be used to set the pressure inside the volume, and hence the boiling point of the working medium.

In an embodiment, the exterior side of the loudspeaker housing contains cooling ribs in the area where the at least one heat pipe is arranged. As a result, the heat provided by the at least one heat pipe can be readily dissipated to the outside of the loudspeaker.

In an embodiment, the at least one heat pipe is permanently and rigidly connected to the permanent magnet. In this way, the basket with the permanent magnet secured therein and the at least one heat pipe form a unit, which simplifies assembly of the loudspeaker in the loudspeaker housing. In addition, permanently and rigidly attaching the heating zone of the at least one heat pipe to the permanent magnet makes it possible to ensure a good heat transfer between the permanent magnet and the at least one heat pipe. In an embodiment, the heat transfer is supported by providing a thermal conductance paste.

In an embodiment, the at least one heat pipe is detachably connected to the loudspeaker housing at the cooling zone and/or displaceably connected to the loudspeaker housing at the cooling zone. This facilitates assembly on the one hand, and on the other hand ensures that the tolerances and thermal tensions can be compensated. In an embodiment, a residual gap can be compensated by providing a thermal conductance paste.

In an embodiment, the cooling zone and/or heating zone of the at least one heat pipe contains a block consisting of a material whose thermal conductivity is at least 100 W/(m*K), and in particular 150 W/(m*K), and the cooling zone or heating zone of the at least one heat pipe is arranged on the permanent magnet respectively loudspeaker housing indirectly by way of the block. Using such a block makes it possible to enlarge the surface over which a heat transfer takes place.

In an embodiment, each block contains one times, and in particular two times the mass of the at least one heat pipe. In an embodiment, the block is made out of metal, in particular copper, silver or aluminium. In an alternative embodiment, the block consists of graphite.

In an embodiment, the block is attached to the permanent magnet or loudspeaker housing via snap jointing, bolting, spring-pressing, soldering, adhesive bonding or welding.

In an embodiment, the loudspeaker housing is made out of plastic, and the area of the loudspeaker housing that complies to the cooling zone of the at least one heat pipe contains a sealed or injected body with a thermal conductivity measuring at least 100 W/(m*K), and in particular at least 150 W/(m*K). For example, a connecting piece comprised of metal or graphite can be incorporated to ensure a high thermal conductivity in this area.

According to an embodiment, the loudspeaker housing and the loudspeaker (especially the diaphragm of the loudspeaker) enclose a fixed volume. According to an embodiment, the loudspeaker is especially hermetically sealed and especially hermetically sealed against outside influences.

According to an embodiment, the housing comprises a pressure compensating valve to balance the air pressure within the housing with external air pressure.

According to an embodiment, the at least one heat pipe does not penetrate the loudspeaker housing. According to an alternative embodiment, the at least one heat pipe does penetrate the loudspeaker housing.

In an embodiment, the permanent magnet contains at least one borehole, in which the heating zone of the at least one heat pipe is arranged, wherein the coil surrounds the borehole at least in sections. In this way, the heating zone of the at least one heat pipe can be located especially close to the coil.

Embodiments relate to a use of the loudspeaker described above for actively extinguishing or influencing sound waves.

Embodiments of a noise control system for exhaust systems of a vehicle powered by an internal combustion engine comprise an antinoise controller and at least one loudspeaker with the above features, which is connected with the antinoise controller to receive control signals, wherein, in response to (as a function of) a control signal received by the antinoise controller, the loudspeaker is designed to generate an antinoise in a noise generator that can be fluidically connected with the exhaust system. Because only very little installation space is often available for the loudspeakers of noise control systems for exhaust systems of a vehicle powered by an internal combustion engine, the selected loudspeaker housing must be correspondingly small. This housing must also be hermetically sealed against outside influences (rain, road salt, etc.). In addition, installation generally takes place next to the ducts of the exhaust system that guide the hot exhaust gases, and hence in an environment where comparatively high temperatures are inherently present.

It is emphasised that the terms "comprise", "contain", "include", "incorporate" and "with" used in this specification and the claims for enumerating features, along with grammatical modifications thereof, are generally to be construed as an inconclusive listing of features, e.g., procedural steps, devices, areas, variables and the like, and in no way preclude the presence of other or additional features or groupings of other or additional features.

BRIEF DESCRIPTION OF THE DRAWINGS

The foregoing as well as other advantageous features of the disclosure will be more apparent from the following detailed description of exemplary embodiments with reference to the accompanying drawings. Not all possible embodiments may necessarily contain each and every, or any, of the advantages identified herein. It is noted that the invention is not limited to the examples in the described exemplary embodiments, but is rather defined by the scope of the attached claims. The following description of exemplary embodiments of the invention refers to the attached figures, in which

Figure 1A:
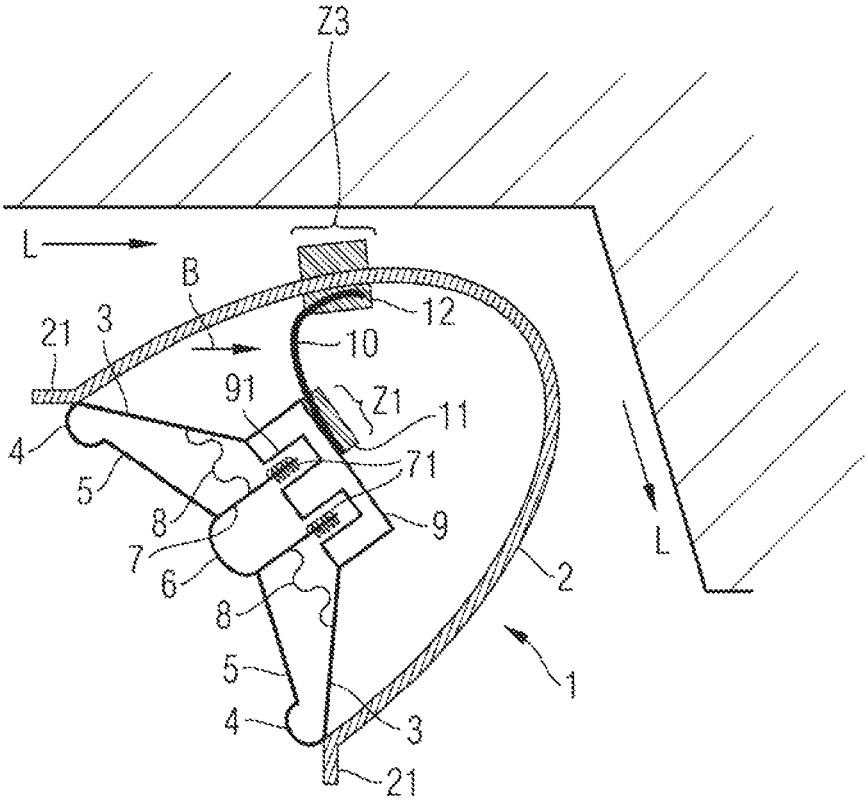
FIG. 1A is a schematic cross sectional view of a loudspeaker according to a first embodiment.

In the exemplary embodiments described below, components that are alike in function and structure are designated as far as possible by alike reference numerals. Therefore, to understand the features of the individual components of a specific embodiment, the descriptions of other embodiments and of the summary of the disclosure should be referred to.

In the following, reference is made to FIGS. 1A, 1B and 1C in describing a loudspeaker according to a first embodiment of the present invention.

The loudspeaker marked overall with reference number 1 comprises a loudspeaker housing 2 made out of plastic, which can be joined by connecting flanges 21 with ducts 101 of an exhaust system of an active noise control system 100. The loudspeaker housing 2 holds a sheet metal basket 3, which carries a permanent magnet 9. The basket 3 has the overall shape of a truncated cone. The basket 3 carries a plastic diaphragm 5*a* via a surround 4 made from flexible plastic. The diaphragm 5 has the overall shape of a truncated cone. A dust cap 6 and bobbin 7 are secured to the top surface of the truncated cone formed by the diaphragm 5. The end of the bobbin 7 averted from the diaphragm 5 is arranged in an annular gap 91 provided in the permanent magnet 9, and carries a voice coil 71. As a result, this coil 17 is located in a constant magnetic field generated by the permanent magnet 9. It is noted that the width of the annular gap 91 on the figure is greatly exaggerated. The bobbin 7 is centred relative to the annular gap 91 by means of a centring spider 8. The centring spider 8 consists of springs radially stretched between the bobbin 7 and basket 3. In the embodiment shown, the basket 3, surround 4, diaphragm 5, dust cap 6, bobbin 7 and permanent magnet 9 are rotationally symmetrical bodies with the same axis of symmetry.

Three heat pipes 10 each having a heating zone Z1 and cooling zone Z3 are arranged on the permanent magnet 9 on the side averted from the basket 3. The heating zones Z1 of the heat pipes 10 are embedded in a massive aluminium block 11. The aluminium block 11 is adhesively bonded face to face and thus over its whole surface facing the permanent magnet 9 with the permanent magnet 9. The cooling zones Z3 of the heat pipes 10 are guided in grooves, which are provided in another massive aluminium block 12. The aluminium block 12 penetrates the wall of the loudspeaker housing 2, and its side averted from the heat pipes 10 contains cooling ribs. This is shown best in FIG. 1B, which depicts the heat pipes 10 along the viewing direction B on FIG. 1A.

Figure 1B:
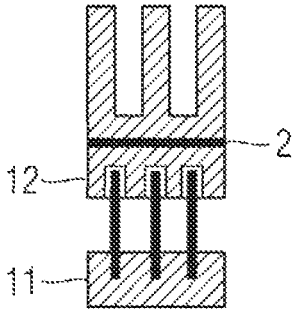
FIG. 1B is a view of the heat pipe according to the first embodiment from FIG. 1A along viewing direction B.
Figure 1C:
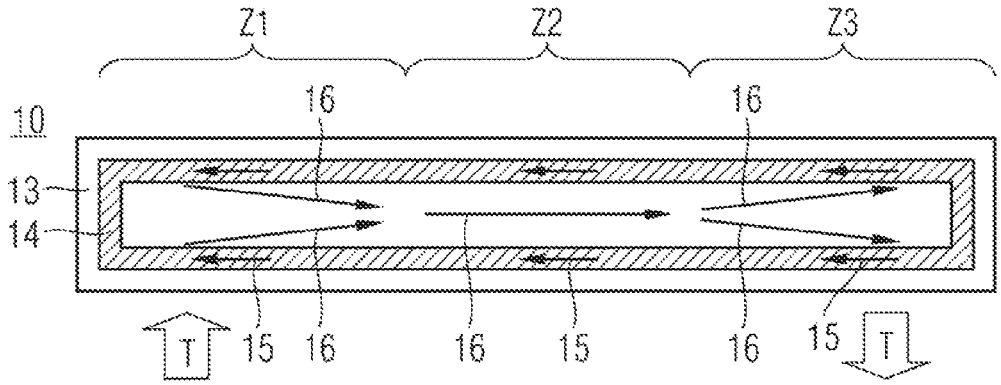
FIG. 1C is a schematic cross sectional view through a heat pipe of the first embodiment from FIG. 1A.

As is evident from FIG. 1A, the cooling ribs of the aluminium block 12 are exposed to air L guided via an air duct.

The function and exact structure of the heat pipes 10 of FIGS. 1A and 1B will be described below by referring to FIG. 1C. FIG. 1C shows a schematic cross sectional view through one heat pipe 10 from FIG. 1A, wherein the heat pipe 10 is not yet bent, but rather extends along a straight line.

The overall cylindrical heat pipe 10 has a wall 13 made out of metal, which provides for a tubular, hermetically sealed volume inside the heat pipe. The wall 13 is lined with a layer of metal braiding 14 on the inside of the heat pipe, which metal braiding 14 provides capillaries. The metal braiding 14 is saturated with a working medium, in this case $(CH_3)OH$. The remaining inner volume of the heat pipe is filled partially with evaporated $(CH_3)OH$ and partially with argon, wherein the argon serves only to set the pressure inside the heat pipe 10, and hence the boiling point of the $(CH_3)OH$.

If energy in the form of heat is supplied to the wall 13 of the heat pipe 10 in a heating zone Z1, the $(CH_3)OH$ located in the metal braiding 14 evaporates into the free interior volume of the heat pipe 10. At the same time, the capillary force causes liquid $(CH_3)OH$ to be fed to the metal braiding 14 located in the heating zone Z1. If energy in the form of heat is simultaneously removed from the wall 13 of the heat pipe 10 in a cooling zone Z3, the gaseous $(CH_3)OH$ again condenses, and saturates the metal braiding 14 located in the cooling zone Z3. At the same time, new, gaseous $(CH_3)OH$ flows into the area of the cooling zone Z3. The flow of liquid $(CH_3)OH$ is denoted on the figure by arrows 15, while the flow of gaseous $(CH_3)OH$ is denoted on the figure by arrows 16. The heating zone Z1 is also referred to as an evaporation zone, and the cooling zone Z3 is also referred to as a condensation zone. The area Z2 between heating zone Z1 and cooling zone Z3 is also known as "adiabatic transport zone".

An advantage of arranging the cooling zone Z3 above the heating zone Z1 of the heat pipe 10 as shown in the first embodiment is that the return flow of working medium in the heat pipe 10 is assisted by gravity. For this reason, usage of a metal braiding that provides capillaries is only optional.

A second embodiment of the loudspeaker 1' according to the invention will be described below, drawing reference to FIG. 2. Since this embodiment is very similar to the first embodiment described above, the following will focus only on differences, with reference otherwise being made to the aforesaid.

The second embodiment differs from the first embodiment described above in that the cooling zone Z3 of the heat pipe 10 is located below the heating zone Z1. As a consequence, transporting back the working medium provided in the heat pipe 10 absolutely requires that corresponding capillaries be arranged in the heat pipe 10. In this second embodiment, the working medium is $NH_3$, and the capillaries are provided by plastic tubules located in the heat pipe 10.

Figure 2:
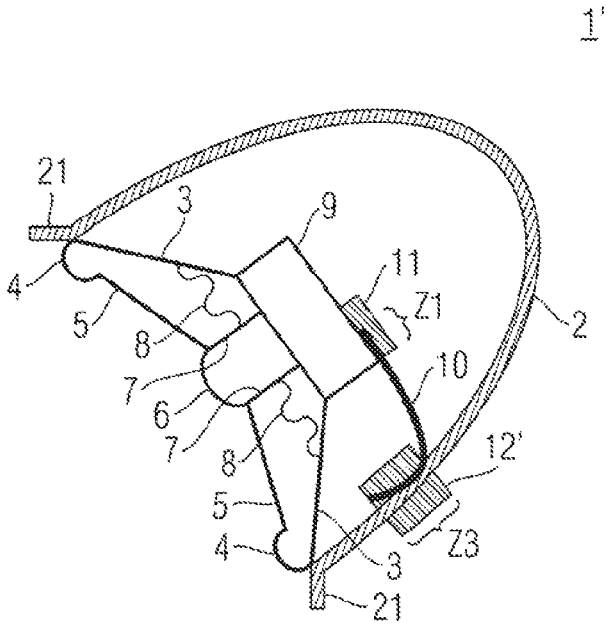
FIG. 2 is a schematic cross sectional view of a loudspeaker according to a second embodiment.

The second embodiment shown on FIG. 2 further differs from the first embodiment described above in that the material 12' that accommodates the cooling zone Z3 of the heat pipe and forms the cooling ribs on the exterior side of the loudspeaker housing 2 is identical to the material forming the loudspeaker housing 2. As opposed to the first embodiment described above, the heat pipes 10 in this embodiment are fixedly joined with the loudspeaker housing 2 in the cooling zone Z3, and in the heating zone Z1 are guided in grooves provided in a copper block adhesively bonded with the permanent magnet 9. A thermal conductance paste is also provided in the grooves to support thermal conduction.

While an annular gap is also arranged in the permanent magnet 9 and the bobbin 7 also carries a voice coil 17 situated in the annular gap in the embodiment on FIG. 2, the annular gap and coil are not shown, other than in FIG. 1A.

A third embodiment of the loudspeaker 1" according to the invention will be described below, drawing reference to FIG. 3. Since this embodiment is very similar to the first and second embodiments described above, the following will focus only on differences, with reference otherwise being made to the aforesaid.

Figure 3:
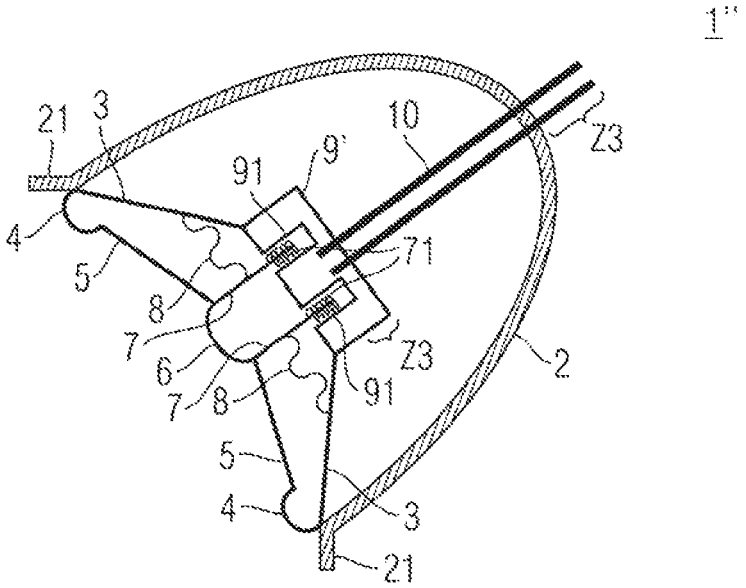
FIG. 3 is a schematic cross sectional view of a loudspeaker according to a third embodiment.

The third embodiment shown on FIG. 3 differs from the first and second embodiments described above in that only two heat pipes 10 are provided, which are directly held in boreholes in the area of their heating zones Z1, which boreholes are provided in the permanent magnet 9 inside of the annular gap 91 accommodating the coil 71. As a consequence, the heat is transferred from the permanent magnet 9 to the heat pipe 10 directly. In the area of their cooling zone Z3, the heat pipes 10 penetrate through the loudspeaker housing 2, and in so doing themselves directly form cooling elements, which are arranged on the exterior side of the loudspeaker housing 2.

Figure 4:
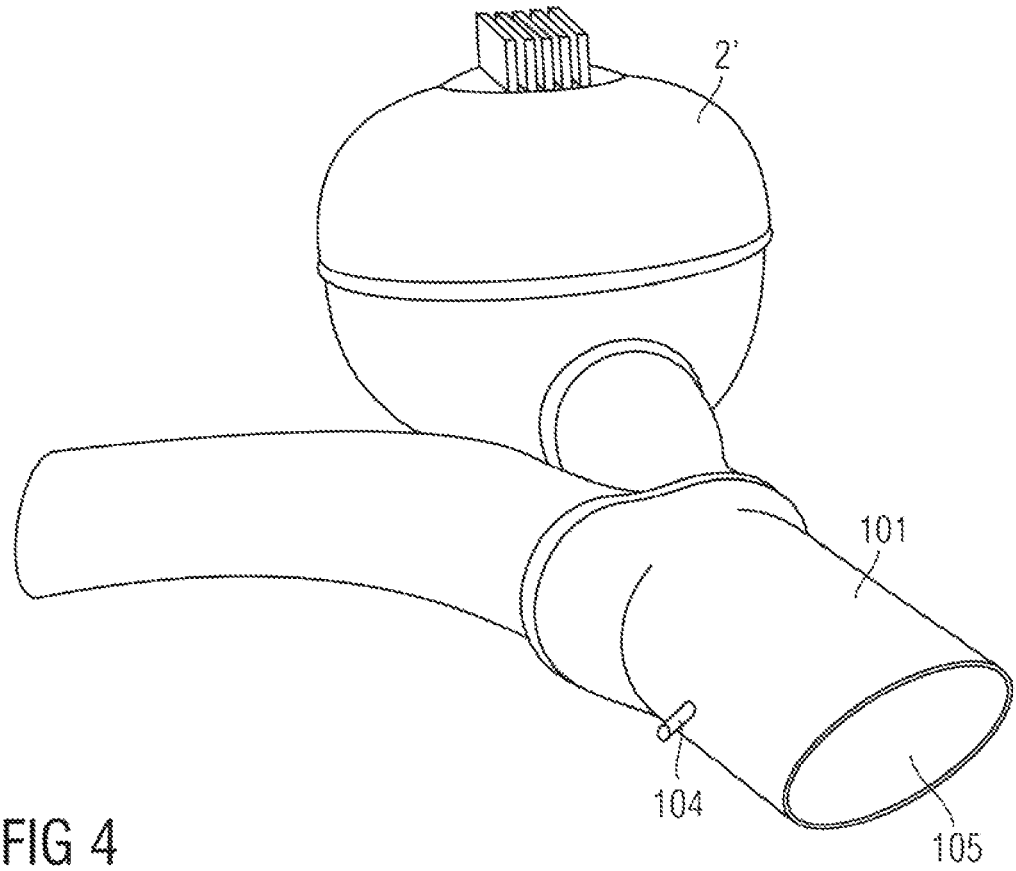
FIG. 4 is a schematic view of components of an active noise control system for exhaust systems of a vehicle powered by an internal combustion engine.
Figure 5:
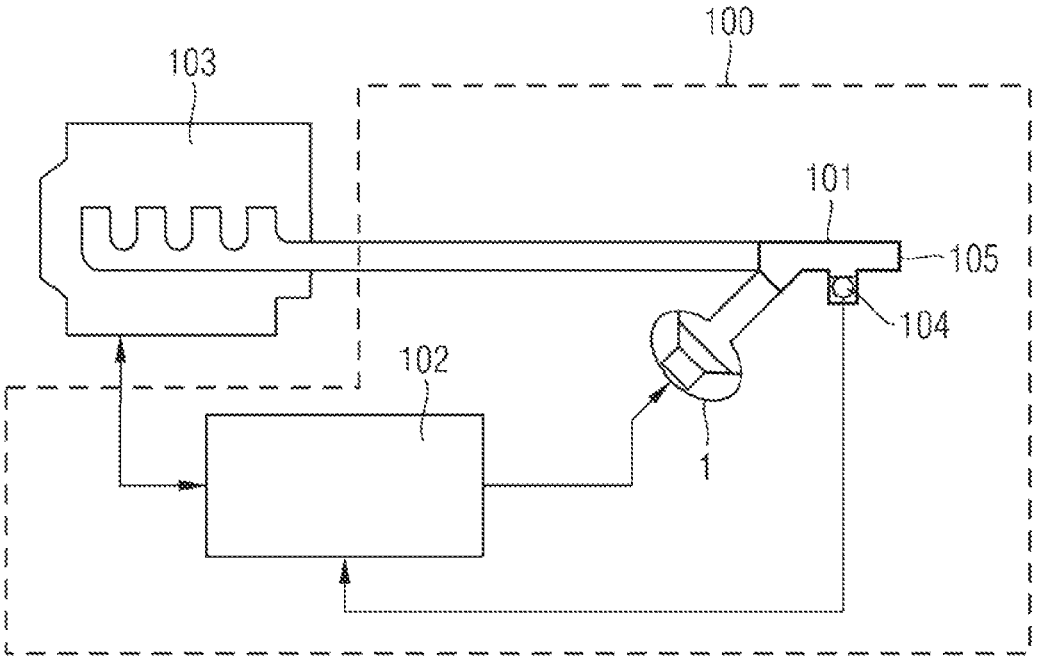
FIG. 5 is a block diagram of the active noise control system from FIG. 4.

Finally, reference is made to FIGS. 4 and 5 in describing the use of a loudspeaker according to the invention for actively extinguishing or influencing sound waves in an active noise control system for exhaust systems of a vehicle powered by an internal combustion engine.

Since the loudspeaker has the structure described in the first embodiment except for a deviating shape for the loudspeaker housing 2', the following will focus only on the special features of the active noise control system.

The active noise control system 100 comprises an antinoise controller 102, which in order to exchange control or measuring signals is electrically connected with the engine controller of an internal combustion engine 103 with an error microphone 104 situated in a duct 101 of an exhaust system of the active noise control system 100, as well as with the loudspeaker 1. As a function of an operating state of the internal combustion engine 103 acquired by the engine controller of the internal combustion engine 103, the antinoise controller 102 calculates control signals, which are fed to the loudspeaker 1 so as to generate antinoise, which extinguishes airborne noise guided in the duct 101 at least partially. The control signal can be further regulated by using signals output by the error microphone 104, so that airborne noise is emitted at a reduced sound pressure at the tailpipe 105 of the exhaust system. The loudspeaker 1 is mounted in the underbody of a motor vehicle in such a way as to be additionally cooled by an airstream as shown in FIG. 1A.

It is be emphasized that the exemplary embodiments described above are only examples, and not intended to limit the scope of protection provided by the claims.

What is claimed is:

1. A loudspeaker comprising:

a loudspeaker housing;

a basket held in the loudspeaker housing and bearing a permanent magnet;

a coil arranged in a constant magnetic field generated by the permanent magnet and connected with a diaphragm; and at least one heat pipe with a heating zone and cooling zone wherein the heating zone is arranged on the permanent magnet, and the cooling zone is arranged on the loudspeaker housing;

wherein the at least one heat pipe is permanently and rigidly connected to the permanent magnet; and wherein the at least one heat pipe is displaceably connected with the loudspeaker housing at the cooling zone.

2. The loudspeaker according to claim 1, wherein the at least one heat pipe comprises:

a tubular, hermetically sealed volume enclosed by a wall; capillaries accommodated inside the volume; and a working medium accommodated inside the volume, which fills the volume in smaller part in liquid state, and in larger part in gaseous state.

3. The loudspeaker according to claim 2, wherein the wall of the at least one heat pipe is made out of metal.

4. The loudspeaker according to claim 2, wherein the capillaries of the at least one heat pipe take the form of at least one of plastic tubules and metal tubules and a fabric and a braiding.

5. The loudspeaker according to claim 2, wherein the working medium accommodated inside the volume of the at least one heat pipe is selected from $(CH_3)OH$, $(CH_3)CO$, $NH_3$, $H_2O$ and $C_6H_6$.

6. The loudspeaker according to claim 1, wherein the exterior side of the loudspeaker housing comprises cooling ribs in the area where the at least one heat pipe is arranged.

7. The loudspeaker according to claim 1, wherein at least one of the cooling zone and the heating zone of the at least one heat pipe comprises a block consisting of a material whose thermal conductivity is at least 100 W/(m*K); and the cooling zone respectively heating zone of the at least one heat pipe is arranged on the permanent magnet respectively loudspeaker housing indirectly by way of the block.

8. The loudspeaker according to claim 1, wherein the loudspeaker housing is made out of plastic, and the area of the loudspeaker housing where the cooling zone of the at least one heat pipe is located, comprises a sealed or injected body with a thermal conductivity measuring at least 100 W/(m*K).

9. The loudspeaker according to claim 1, wherein the permanent magnet has at least one borehole, in which the heating zone of the at least one heat pipe is arranged, wherein the coil surrounds the borehole at least in sections.

10. The loudspeaker according to claim 1, wherein the loudspeaker is sealed against outside influences.

11. A loudspeaker comprising:

a loudspeaker housing;

a basket held in the loudspeaker housing and bearing a permanent magnet;

a coil arranged in a constant magnetic field generated by the permanent magnet and connected with a diaphragm; and at least one heat pipe with a heating zone and cooling zone, wherein the heating zone is arranged on the permanent magnet, and the cooling zone on the loudspeaker housing;

wherein the loudspeaker housing is made out of plastic, and the area of the loudspeaker housing where the cooling zone of the at least one heat pipe is located, comprises a sealed or injected body with a thermal conductivity measuring at least 100 W/(m*K);

wherein the loudspeaker is sealed against outside influences; and wherein the exterior side of the loudspeaker housing comprises cooling ribs in the area where the at least one heat pipe is arranged.

12. The loudspeaker according to claim 11, wherein the heat pipe comprises:

a tubular, hermetically sealed volume enclosed by a wall made out of metal;

capillaries accommodated inside the volume, wherein the capillaries take the form of at least one of plastic tubules and metal tubules and a fabric and a braiding; and a working medium accommodated inside the volume, which fills the volume in smaller part in liquid state, and in larger part in gaseous state, wherein the working medium accommodated inside the volume of the at least one heat pipe is selected from $(CH_3)OH$, $(CH_3)CO$, $NH_3$, $H_2O$ and $C_6H_6$.

13. The loudspeaker according to claim 11, wherein the at least one heat pipe is permanently and rigidly connected to the permanent magnet.

14. The loudspeaker according to claim 13, wherein the at least one heat pipe is detachably or displaceably connected with the loudspeaker housing at its cooling zone.

15. The loudspeaker according to claim 14, wherein at least one of the cooling zone and heating zone of the at least one heat pipe comprises a block consisting of a material whose thermal conductivity is at least 100 W/(m*K); and the cooling zone respectively heating zone of the at least one heat pipe is arranged on the permanent magnet respectively loudspeaker housing indirectly by way of the block.

16. The loudspeaker according to claim 14, wherein the permanent magnet has at least one borehole, in which the heating zone of the at least one heat pipe is arranged, wherein the coil surrounds the borehole at least in sections.

* * * * *